United States Patent [19]

Polizzi

[11] 4,280,590

[45] Jul. 28, 1981

[54] STABILIZING ATTACHMENT FOR LADDERS

[75] Inventor: Louis M. Polizzi, West Palm Beach, Fla.

[73] Assignee: Polizzi Enterprises, West Palm Beach, Fla.

[21] Appl. No.: 154,279

[22] Filed: May 29, 1980

[51] Int. Cl.[3] ..... E06C 7/48

[52] U.S. Cl. ..... 182/214; 182/107; 182/229; 248/210

[58] Field of Search ..... 182/214, 206, 107, 108, 182/229; 248/210, 211, 238

[56] References Cited

U.S. PATENT DOCUMENTS

| | | | |
|---|---|---|---|
| 1,393,922 | 10/1921 | Taylor | 182/214 |
| 1,467,597 | 9/1923 | Wendel | 182/214 |
| 1,508,392 | 9/1924 | Heun | 182/214 |
| 1,543,551 | 6/1925 | Couche | 182/214 |
| 1,800,792 | 4/1931 | Hansen | 182/214 |
| 2,100,918 | 11/1937 | Ringman | 182/214 |
| 2,307,543 | 1/1943 | Reed | 182/214 |
| 2,432,189 | 12/1947 | Bucher | 182/214 |
| 2,605,950 | 8/1952 | Colvin | 182/214 |
| 2,815,160 | 12/1957 | Gilmour | 182/107 |
| 3,288,249 | 11/1966 | Gibson | 182/214 |
| 3,318,416 | 5/1967 | Robinson | 182/214 |
| 3,603,431 | 9/1971 | Nameche | 182/214 |
| 3,853,202 | 12/1974 | Jarboe | 182/206 |
| 4,061,203 | 12/1977 | Spencer | 182/214 |

*Primary Examiner*—Reinaldo P. Machado
*Attorney, Agent, or Firm*—Wolf, Greenfield & Sacks

[57] ABSTRACT

A pair of ladder brackets held together by an elastic tie at one end of each having U-shaped clamps at the other ends for engaging the narrow sides of the side rails of a ladder when the brackets are fitted to the outer wide sides of the side rails. The elastic tie holds the U-shaped clamps against the inner wide sides of the rails. The brackets can be slid along the rails without interference from the rungs. The free ends of the brackets engage the roof of a building against which the ladder leans, to prevent the ladder from being displaced sideways. The brackets can be carried in a small package up a ladder by a user, and installed while the user is standing on the ladder.

10 Claims, 3 Drawing Figures

STABILIZING ATTACHMENT FOR LADDERS

PRIOR DISCLOSURE

This invention is the subject of Disclosure No. 077,826 under the Disclosure Document Program in the U.S. Patent and Trademark Office.

BACKGROUND OF THE INVENTION

This invention relates generally to stabilizing attachments for ladders. More particularly, the invention provides a pair of brackets for easy attachment to the side rails of a ladder for the express purpose of keeping a ladder from being displaced sideways, as by the wind, when the ladder is leaned against a house or other building. The need to prevent ladders from being blown or otherwise displaced sideways along the wall or roof edge against which the ladder rests, including when no person is on the ladder, has long been recognized. The Department of Labor, O.S.H.A., has published rules for use of ladders which include the following: "Portable ladders shall be lashed, blocked or otherwise secured to prevent their being displaced" (Federal Register, Vol. 39, No. 119, June 19, 1974, page 22012, Sec. 1915.42(3); Vol. 44, No. 29, Feb. 9, 1979, page 8626, Sec. 1926.450(10)-26 CFR 1926 with 29 CFR Part 1910).

THE PRIOR ART

The closest prior art of which the Applicant is presently aware is set forth in a Prior Art Statement under 37 CFR 1.97 which accompanies this application.

THE INVENTION

The present invention improves in many respects upon the prior art. A simple two-piece attachment is provided which can be carried up a ladder by a user, and attached to the side rails at any position while the user is standing on the ladder, and, after being installed, the attachment can be adjusted along the ladder without regard to rung positions.

In a specific embodiment which is described in this specification, two brackets which are essentially mirror images of each other have wide arms each with a U-shaped end intended to clamp around a narrow side of one of the side rails, with the wide arms on opposite outer wide sides of the rails. An elastic rope or the like connects the ends of the wide sides of the brackets which extend away from the other narrow sides of the side rails, and this elastic rope holds the brackets in place. Each bracket has means to adjust its dimensions with relation to width and thickness of the side rails, and after the two brackets constituting the attachment have been installed on the side rails, they can be slid along the side rails free of the ladder rungs, for adjustment along the ladder. The free ends of the wide sides of each bracket are used to contact the roof of the structure against which the ladder leans, for preventing sidewise displacement. The two brackets can be carried in a small package by a user ascending a ladder, who can install them anywhere along the ladder while standing on the ladder. Thus, with the present invention, a user can place a ladder against the side of a building, climb to the top carrying the small bracket package with him or her, install the attachment and adjust it along the ladder so as to engage the adjacent surface of the roof of the building, and then climb down from the ladder, leaving the ladder safely braced against sidewise displacement.

DETAILED DESCRIPTION OF THE INVENTION

Figure 1:
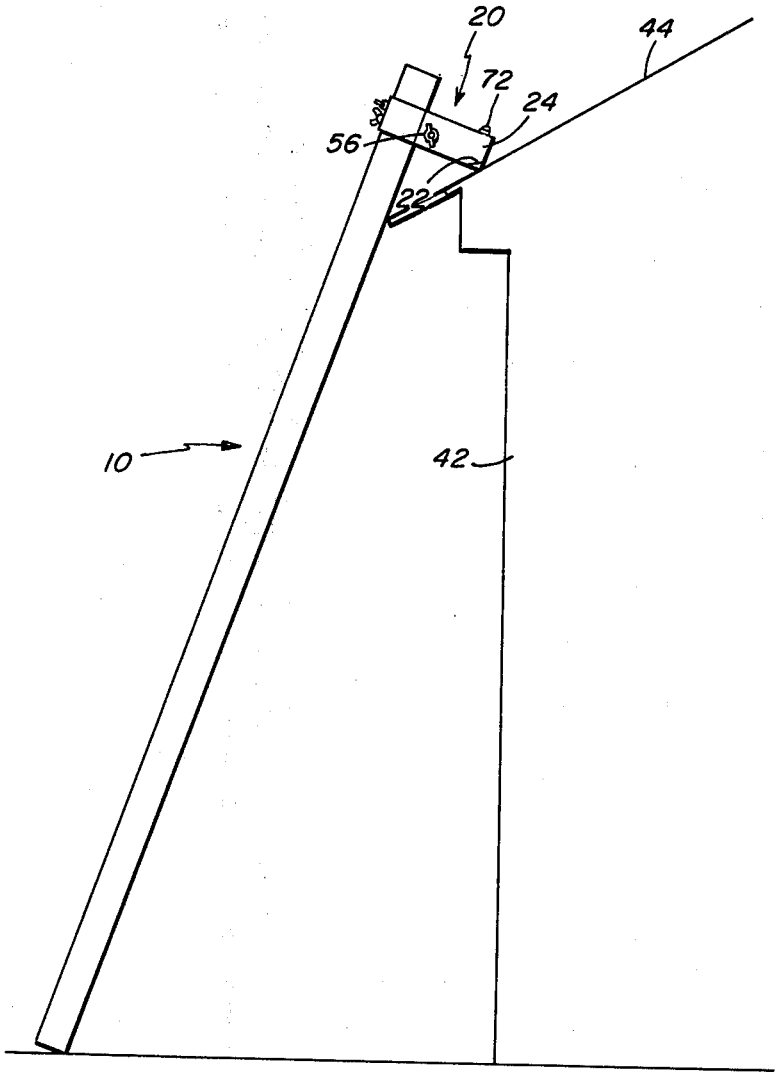
FIG. 1 is a side view of a ladder bearing an attachment of the invention, leaning against a building with a sloped roof.

FIG. 1 shows a ladder 10 leaning against a building 42, with a sloping roof 44. A bracket 20 according to the invention is schematically shown fitted to a side rail of the ladder and having a corner foot 22 of its free end 24 overhanging the roof 44 and in contact with the roof surface. The invention is so simple, and yet so novel, that FIG. 1 illustrates how far the invention is removed from the vastly more complex articles and apparatus of the prior art. Tnis characteristic of simplicity is carried through the entire design of the present invention.

Figure 3:
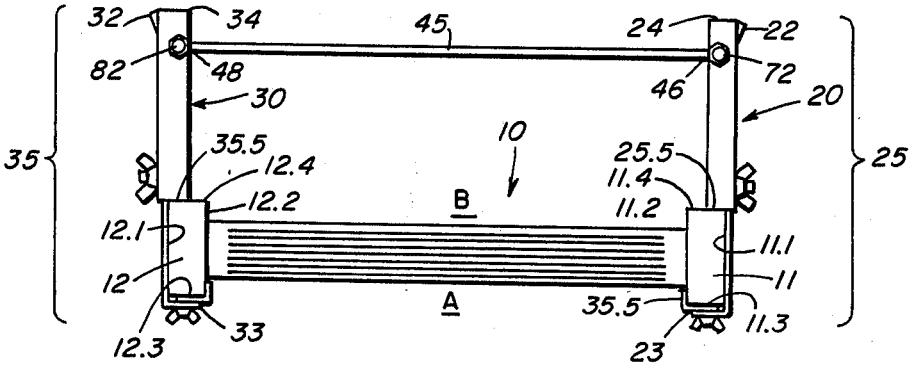
FIG. 3 is a transverse section through a ladder showing the brackets of the invention installed on the ladder.
Figure 2:
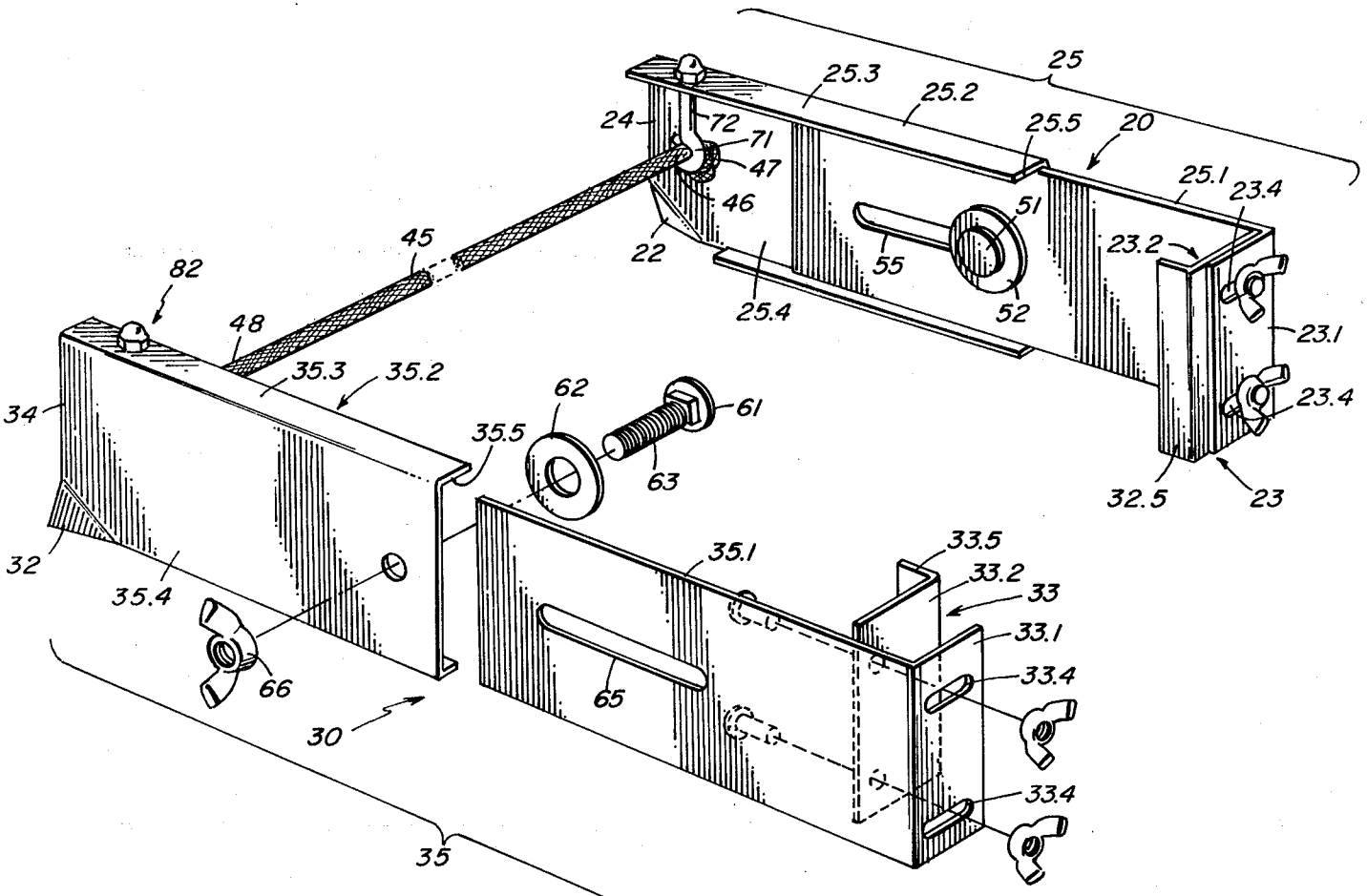
FIG. 2 illustrates two brackets according to the invention with an elastic tie resiliently binding them together.

FIG. 2 shows a pair of brackets 20 and 30, respectively, which are mirror-images each of the other. One bracket 20 will be described in detail, with the aid of FIG. 3. In the latter figure, the ladder 10 to which the brackets are attached is shown in transverse section. The ladder comprises first and second side rails 11 and 12, respectively, joined at intervals by rungs 13, of which one is shown. First respective sides 11.1 and 12.1 of the rails face outwardly from each other. Second respective 11.2 and 12.2 sides of the rails face inwardly toward each other. Third respective sides 11.3 and 12.3 of the rails face to a first side A of the ladder. Fourth respective sides 11.4 and 12.4 of the rails face to a second side B of the ladder. In FIG. 1, side B of the ladder is nearer to the building 42 than the side A, which for convenience may be termed the "outer side of the ladder". Continuing with FIG. 3, each of the brackets 20, 30, has an elongated portion 25, 35, respectively, terminating at one end in a generally U-shaped clamp 23, 33, respectively, extending to one side of the elongated portions 25, 35, respectively, each clamp being contoured to fit around the third side 11.3, 12.3, respectively, of one of the rails 11, 12, respectively, and to overlap in part the second side 11.2, 12.2, respectively, of said one rail, when the elongated portion 25, 35, respectively, lies against the first side 11.2, 12.2, respectively, of said one rail, with its free end 24, 34 extending away from the second side B of the ladder. A resilient connector 45, which may be an elastic rope, is fastened at each end to one of the elongated portions 25, 35, respectively, near the respective free ends 24, 34, thereof. Each elongated portion 25, 35 comprises a base member 25.1, 35.1, respectively, and an adjustable member 25.2, 35.2, respectively, on an end of which the corner foot 22, 32, respectively, is formed. The base member and adjustable member of each bracket are connected together in a manner (see FIG. 2) permitting the length of the elongated portion of that bracket to be adjusted. Each adjustable member 25.2, 35.2, respectively, has an L-shaped cross section, a shorter flat part 25.3, 35.3, respectively, of which is at an angle to a longer flat part 25.4, 35.4, respectively, of that adjustable member. When the longer flat part 25.4, 35.4, respectively, of each member is against the base member 25.1, 35.1, respectively, of the respective elongated portion 25, 35, the short flat part 25.3, 35.3, respectively, extends from it transverse to the ladder rail 11, 12, respectively, to which the respective bracket is attached. By adjusting the adjustable member along the base member of each bracket, the transverse edge 25.5, 35.5, at the end of each adjustable member that is closest to the respective fourth side 11.4, 12.4 of the rail to which the respective bracket is attached can be brought into engagement with the respective fourth side of the respective rail. The corner foot 22, 32, of each bracket is formed at the other end of each adjustable member 25.2, 35.2, respectively.

FIG. 2 illustrates in greater detail how a preferred form of a bracket according to the invention is constructed. Referring to second bracket 30, the base member 35.1 has an elongated slot 65 in it. A corresponding slot 65 is in the base member 35.1 of the first bracket 30. As is more easily seen in the second bracket 30, the adjustable member 35.2 has a hole 64 for a bolt 63 which passes through the slot 65 and the hole 64. A washer 62 is under the bolt head 61 on the confronting surface of the base member 35.1, and a wing-nut 66 covers the hole 64 and is used to tighten the bolt 63 to fix an adjustment of the adjustable member 35.2 along the slot 65. Corresponding bolt head 51 and washer 52 are seen in the first bracket 20.

The resilient connector 45 is fastened at one end 46 to the adjustable member 25.2 of the first bracket, being passed through the eye 71 of an eye bolt 72 which is bolted to the shorter flat part 25.3 of the adjustable member near the free end 24 of it. A knot 47 in the end 46 of the resilient connector retains the resilient connector in the edge 71 between the eye bolt 7 and the longer flat part 25.4 of the adjustable member 25.2. This arrangement protects the knot 47 from abrasion, and helps to assure that the resilient connector 45 will remain attached to the first bracket 20. A similar construction is provided on the second bracket 30 for the second end 48 of the resilient connector, where the location of the bolt 82 is indicated.

The U-shaped clamps 23 and 24, respectively, are made in two parts which are adjustable for the widths of the respective ladder rails. The first clamp 23 has a fixed member 23.1 and an adjustable member 23.2. Slots 23.4 in the fixed member pass bolts 91 which also pass outward through holes (not shown in the first bracket 20) in the adjustable member 23.2, and wing nuts 92 are used to tighten these bolts at any desired location along the slots 23.4. The adjustable member has a flange 23.5 which is brought snugly against the inward-facing side 11.2 of the first rail 11 when the first bracket 20 is fitted to that rail with its elongated portion 25 snugly against the outward-facing side 11.1 of the first rail 11, and the U-shaped clamp 23 is adjusted to the width of the third side 11.3 of that rail facing to side A of the ladder. Similar adjustment of the U-shaped clamp 33 of the second bracket can be made, as is readily seen in the illustration.

The present invention provides a simple structure with maximum flexibility of adjustment. Each bracket can be adjusted to the width and the thickness of the ladder rail to which it is attached, without distorting the clamping mechanism. The wrap around feature afforded by the flanges 23.5 and 33.5 is so designed that the brackets can be clamped in a pair around the outer side A of the rails and then will be held in position by the resilient connector 45. The brackets slide up and down the rails and if the adjustment of the adjustable members 25.2 and 35.2 on the base members 25.1 and 35.1, respectively, is made tight enough, they will tend to hold very tightly on the ladder rails. When tension is applied by the resilient connector, binding takes place on the inner side faces of the rails and at the front edges 25.5 and 35.5 of the adjustable members 25.2 and 35.2, respectively, and this all tends to lock each bracket in place on its rail. However, to remove the entire assembly from a ladder one merely grasps the free ends 24 and 34 of the brackets, pulls them apart against the resilient connector 45, and the brackets come away from the side rails of the ladder.

The mode of installation of the brackets of the invention is unique. The adjustments herein described can be made to any given ladder while the ladder is lying flat on the ground, or after it is erected. In either case, the bracket can be placed in a pocket or in a pouch or tied onto the user's belt. The user erects the ladder, goes up on the ladder to a roof, for example, and then installs the bracket on the ladder while it is erect. That cannot be done with any prior bracket. Brackets that are shown in the prior art must be installed while the ladder is on the ground, and typically little or no adjustment is possible after the ladder has been made vertical and leaned against the side of a building. Brackets of the invention can be snapped on the rails of a ladder in a matter of seconds, while the ladder is erect. In prior brackets, if they can be put on when the ladder is vertical, numerous adjustments have to be made while the ladder is in place and that is very difficult for a man standing on a ladder. With the present invention it is, by contrast, easier to make adjustments while the ladder is erect then when the ladder is lying on the ground. Then, after one has made the needed adjustments, the brackets can be attached anywhere on the ladder rails, just by snapping them on. Once a pair of brackets is adjusted to the ladder that the user is going to carry to all his jobs, there are essentially no further adjustments to make on the brackets according to the present invention, as long as those adjustments remain tight. This is a unique feature of the invention.

I claim:

1. A stabilizing attachment for a ladder having first and second side rails of substantially rectangular cross-section joined at intervals by rungs, wherein first respective sides of said rails face outwardly away from each other, second respective sides of said rails face inwardly toward each other, third respective sides of said rails face to a first side of said ladder, and fourth respective sides of said rails face to a second side of said ladder, said attachment comprising first and second elongated brackets intended, when fitted respectively to said first and second side rails, to engage the roof of a structure against which the ladder leans for preventing displacement of the ladder along the edge of the roof, each of said brackets being substantially the mirror image of the other, each bracket having an elongated portion terminating at one end in a generally U-shaped clamp extending to one side of said elongated portion, said clamp being contoured to fit around the third side of one of said rails and to overlap in part the second side of said one rail when said elongated portion lies against the first side of said one rail with its other end extending away from said second side of said ladder, adjustable means fitted to said elongated portion of each bracket near said other end thereof, for engaging said fourth side of the rail to which said bracket is attached, and resilient means connected between said elongated portions in the region of said other ends extending away from said second side of said ladder and pulling said extending portions toward each other when said brackets are fitted to said side rails for holding said clamps tightly against said respective second sides of said rails, said brackets being slidable along said rails when fitted to said rails for adjusting the position of said attachment along said ladder.

2. A stabilizing attachment according to claim 1 including an outwardly flared corner at the extremity of said other end of each of said elongated portions, for restraining the ladder against said displacement when leaned against the structure.

3. A stabilizing attachment according to claim 2 in which each said outwardly-flared corner is a part of said adjustable means that is fitted to said elongated portion of each bracket.

4. A stabilizing attachment according to claim 1 including means to adjust the width of said U-shaped clamp of each bracket to the distance between said first and second sides of the rail to which the bracket is fitted.

5. A stabilizing attachment according to claim 1 in which said adjustable means of each bracket comprises a body of generally L-shaped transverse section, a wider part of said body being slidably affixed to said elongated portion of said bracket with the narrower part extending to the same side of said elongated portion as said U-shaped clamp, the edge of said narrower part at the end thereof nearer to said U-shaped clamp being engageable with said fourth side of the rail to which said bracket is attached by moving the wider part of said adjustable means body relative to said elongated portion of said bracket, and means to lock said adjustable means in a position on said elongated portion.

6. A stabilizing attachment according to claim 5 in which said adjustable means of each bracket extends away from said second side of said ladder to provide the extremity for said elongated portion, and said resilient means is connected between both of said adjustable means near the extremity of the wider part of the body of each of said adjustable means.

7. A stabilizing attachment according to claim 6 in which a corner of the extremity of each of said wider parts is bent outwardly relative to the other of said adjustable means so as to provide two relatively outwardly-flared corners at the respective extremities of the two brackets farthest removed from said second side of said ladder, for restraining the ladder against said displacement.

8. A stabilizing attachment according to claim 1 in which said resilient means is an elastic band connected at each end to one of said elongated portions.

9. A stabilizing attachment according to claim 6 in which said resilient means is an elastic band connected between said adjustable means.

10. A stabilizing element according to claim 1 in which the end of the U-shaped clamp of each bracket is restricted in length so as to overlap only a limited portion of said second side of the rail to which said bracket is fitted and thereby to leave said bracket free to slide along said rail clear of the rungs of the ladder.

* * * * *